US005946724A

United States Patent [19]

Erickson

[11] Patent Number: 5,946,724

[45] Date of Patent: Sep. 7, 1999

[54] GOLF JACKET

[75] Inventor: Mark Edward Erickson, Oakland, Calif.

[73] Assignee: Acushnet Company, Fairhaven, Mass.

[21] Appl. No.: 09/069,874

[22] Filed: Apr. 30, 1998

[51] Int. Cl.[6] ..... A41B 1/00

[52] U.S. Cl. ..... 2/93; 2/108; 2/85

[58] Field of Search ..... 2/69, 85, 83, 93, 2/94, 108, 96, 102, 125, 105, 106, 243.1, 220, 221, 269, 270, 236, 237, DIG. 4

[56] References Cited

U.S. PATENT DOCUMENTS

| | | | |
|---|---|---|---|
| 1,209,311 | 12/1916 | Levinson . | |
| 1,214,893 | 2/1917 | Butler . | |
| 1,251,996 | 1/1918 | Fuerst . | |
| 1,721,074 | 7/1929 | Gross . | |
| 1,965,995 | 7/1934 | Tripp | 2/93 |
| 2,112,788 | 3/1938 | Rosenberg . | |
| 2,113,911 | 4/1938 | Bjornson | 2/93 |
| 2,180,497 | 11/1939 | Barkin . | |
| 2,226,486 | 12/1940 | Weisend . | |
| 2,255,823 | 9/1941 | Silverstein . | |
| 2,292,348 | 8/1942 | Bailey . | |
| 2,322,451 | 6/1943 | Jones . | |
| 2,391,352 | 12/1945 | Schwartz | 2/93 |
| 2,398,258 | 4/1946 | Seegal . | |
| 2,415,996 | 2/1947 | Eilenberg . | |
| 2,443,447 | 6/1948 | Falcon | 2/93 |
| 2,492,097 | 12/1949 | Katz . | |
| 2,500,351 | 3/1950 | Farber et al. . | |
| 2,603,789 | 7/1952 | Straus . | |
| 2,846,686 | 8/1958 | Tames . | |
| 3,086,215 | 4/1963 | Di Paola | 2/93 |
| 4,164,792 | 8/1979 | Ito . | |
| 4,543,670 | 10/1985 | Ehring . | |
| 4,608,715 | 9/1986 | Miller et al. | 2/108 X |
| 4,631,753 | 12/1986 | Ehring . | |
| 4,896,379 | 1/1990 | Kape . | |
| 5,138,717 | 8/1992 | Tolton . | |
| 5,218,720 | 6/1993 | Tolton . | |
| 5,283,910 | 2/1994 | Flint . | |
| 5,351,340 | 10/1994 | Aldridge | 2/108 |

*Primary Examiner*—Gloria Hale
*Attorney, Agent, or Firm*—Pennie & Edmonds LLP

[57] ABSTRACT

A garment that has a liner and an outer shell defining an inner space therebetween. An elastic cinch has ends that are anchorable to the shell. At least one of the ends is located within the inner space and has an end that extends to the outside of the shell through an opening in the shell. This end is manipulable from the outside of the shell for anchoring to the shell selectively in first and second positions relative thereto. When both ends are anchored, a closed path about a body part is defined by the cinch and by a tensionable portion of the shell between locations at which the ends are anchored. The stretch of the cinch can be selected by anchoring the end at different positions relative to the shell. Sleeves of the garment include first and second panels that extend from the shoulder to the wrist of the sleeve have convex edges attached to each other by a back seam. The edges have a curvature of a radius that diminishes towards the elbow.

26 Claims, 8 Drawing Sheets

GOLF JACKET

BACKGROUND OF THE INVENTION

All-weather jackets ordinarily have an outer shell and an inner liner to insulate the jacket and keep out water and wind. Jackets are also generally tailored to fit a standing human. Thus, a typical jacket includes a torso portion and sleeves that are designed to fit smoothly on a wearer when he or she is standing, but which may bunch up at undesirable locations when the posture of the wearer is other than upright.

When the wearer plays golf, for example, the wearer experiences a number of shortcomings with traditional jackets. A proper golf stance requires the wearer to bend forward at the waist and abdominal sections of the body. As the distance across the front of the wearer from the shoulders to the waist decreases, the liner and shell of a common jacket bunch up at the front of the jacket, producing a full belly shape. This fullness interferes with a golf swing as fabric of the jacket protrudes into the arcuate path through which the arms of the wearer must travel.

U.S. Pat. No. 5,218,720 discloses a jacket with a yieldable material sewn into a back panel of an otherwise unyielding liner to contact the back of a wearer. Horizontal straps with snaps are sewn to the back panel and front panels of the liner. The liner may be adjusted by attaching snaps to receptacles on the same strap. As a result, the insert is pressed against the back of the wearer, without producing bunching of the shell of the jacket. This teaching however, does not diminish any bunching of the shell itself produced when the wearer bends. The front of the jacket would still bunch up and interfere with a golf swing when the wearer leans forward. Also, as the snaps are located inside the jacket, the wearer must first remove the jacket to make an adjustment, then try on the jacket again for fit, and iterate these steps until a comfortable adjustment is achieved.

Other patents teach different adjustable jacket liners. For instance U.S. Pat. No. 2,391,352 teaches a coat with a band disposed between a shell and a liner. Ends of the band protrude into the inside of the jacket and attach to each other to pull the liner about the wearer.

Also, traditional sleeves are made from a single fabric panel sewn to itself along a single, straight seam. The panel is generally cut to taper towards the wrist. Often, fabric gussets with convex sides are sewn to the sleeves at the back of the elbow to provide additional room. Pleats leading to the elbow have also been employed to increase elbow room to enable a wearer to bend his or her arm. Lack of material at the elbow can causes the sleeve cuff to be pulled back from the wearer's wrist during certain arm motions.

As a solution to this problem, U.S. Pat. No. 5,138,717 teaches a piston and cylinder cuff that includes a wristlet mounted inside a false cuff by conical gussets. Thus the wristlet, engaged against a wearer's wrist, can telescope within the false cuff to prevent the wristlet from riding up on the arm of the wearer during an arm swinging motion.

The prior art sleeves designed to allow increased motion of the wearer's arm are either excessively baggy, and bunch up during certain motions, or require a large number of pieces of fabric and stitching. A small number of fairly simple seams is desirable to minimize production complexity and cost.

SUMMARY OF THE INVENTION

The invention relates to a garment with reduced fabric bunching in a portion of an outer shell of the garment. The garment is preferably a golf jacket in which fullness is removable from a tensionable abdomen region and in the sleeves, but in which is permitted a full range of motions required when playing a sport, such as golf. The jacket has a liner, a shell, and an elastic cinch extending therebetween. Ends of the cinch protrude to the outside of the shell and are anchorable to the shell. The ends are manipulable from the outside of the jacket and preferably protrude from between the shell and the liner through holes in the shell disposed within pockets on the outside of the shell.

When the ends of the cinch are anchored to the shell, the cinch flattens the front of the abdomen, preventing otherwise bunched-up fabric from interfering with the wearer's golf swing. The tension in the cinch is adjustable by anchoring the cinch end to the shell in one of various relative positions.

The sleeves of the jacket constructed according to the invention include at least two panels with convex edges that are attached to each other by a back seam, extending along the back of the sleeve, from the shoulder to the elbow to the wrist of the sleeve. The convex edges are curved at a radius that decreases towards the elbow. In the preferred embodiment, sleeve panels are also attached to each other by front and bottom seams. Panel edges joined at the front seam are concave, and one of the panel edges joined at the bottom seam is convex while the other is concave. These seams permit localized control of the shape of the sleeve to provide a desired curvature and extra material where needed, such as at the elbow, and to remove fullness where fullness would be detrimental, such as in the front of the sleeve. The tendency of the cuff at the sleeve wrist to ride-up on the arm during a golf swing is greatly reduced without the need for complex additional gussets or pleats.

DETAILED DESCRIPTION OF THE PREFERRED EMBODIMENTS

Figure 1:
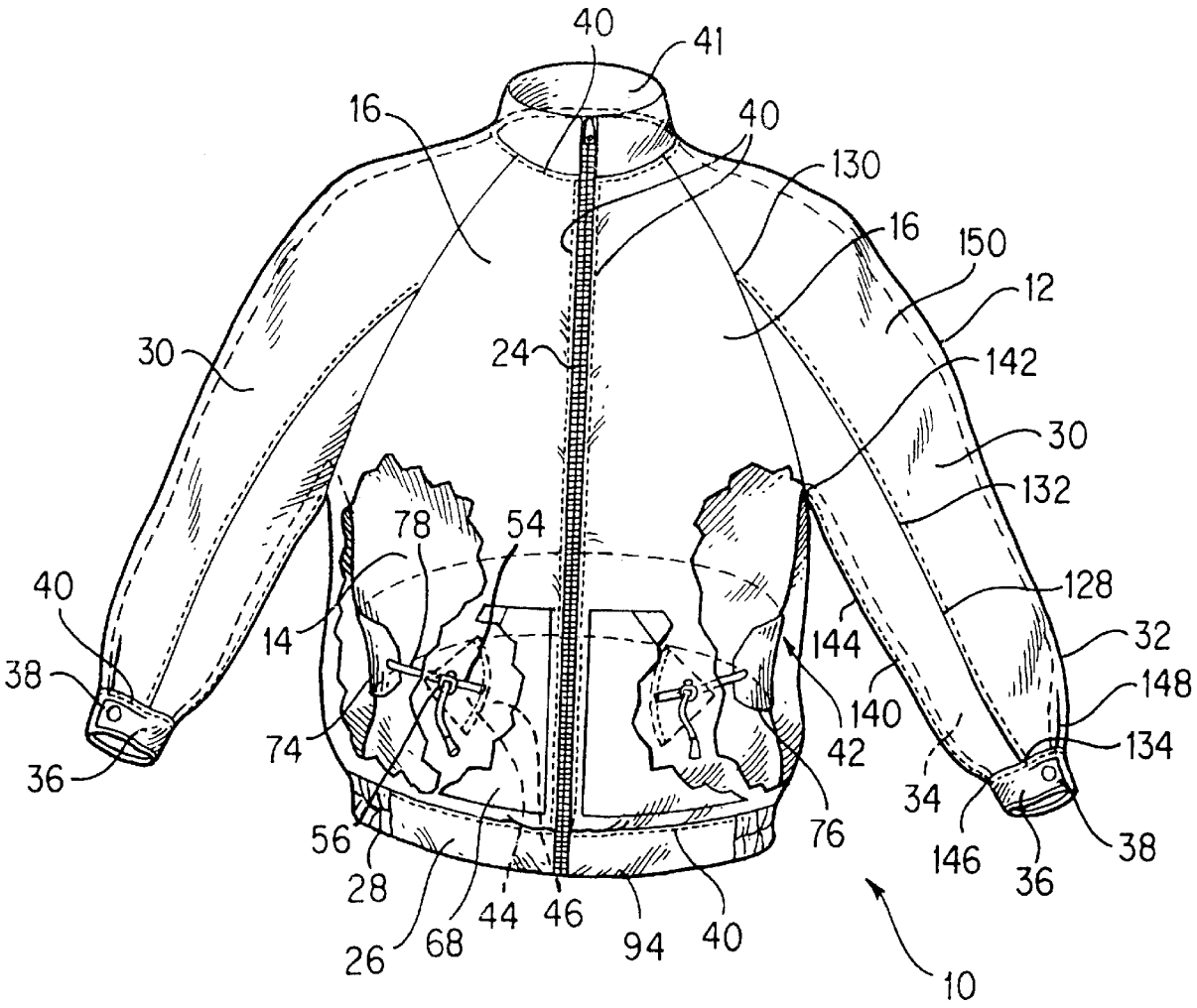
FIG. 1 is a cutaway front view of a preferred embodiment of a jacket constructed according to the invention.
Figure 2:
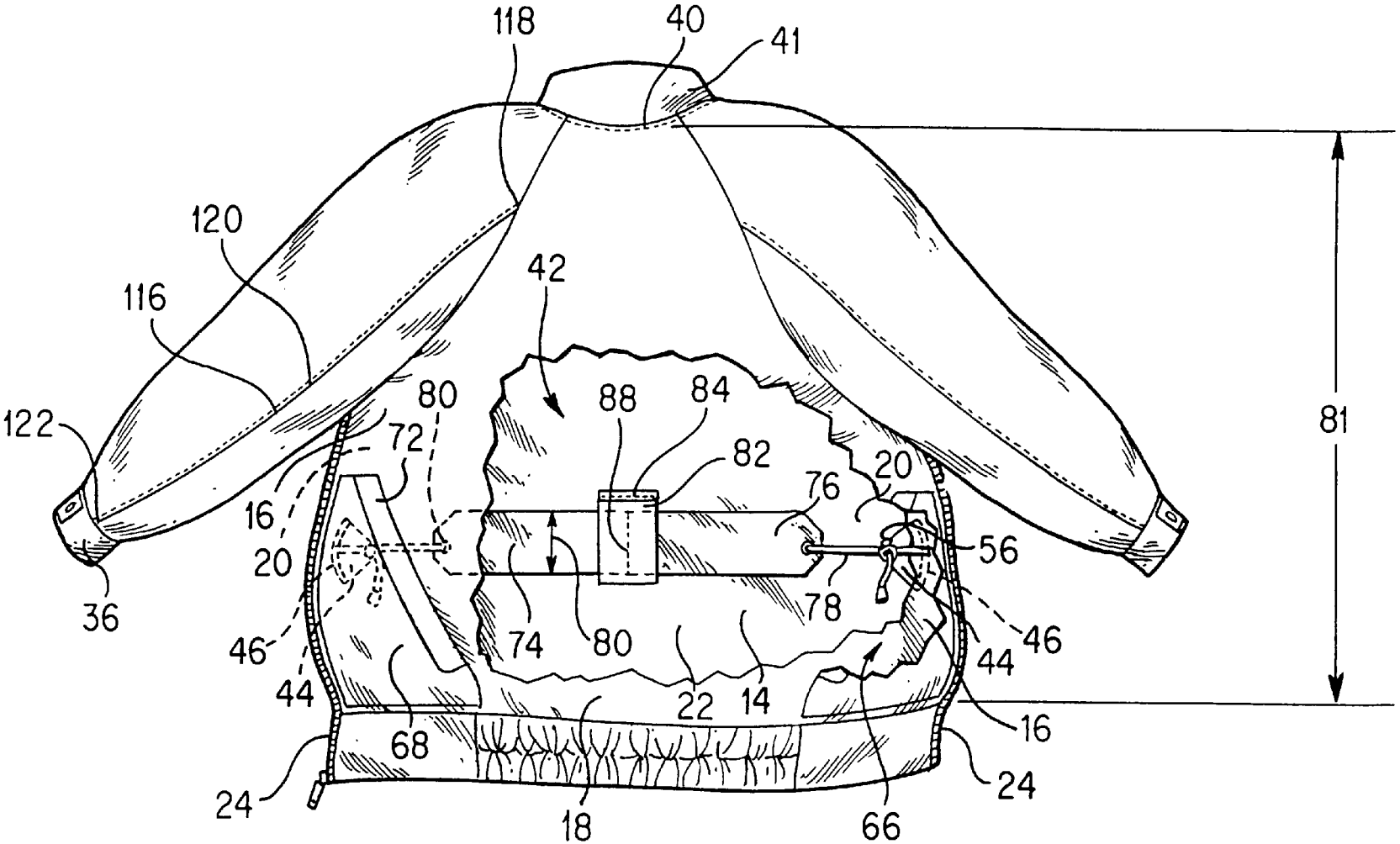
FIG. 2 is a cutaway back view of the jacket.

Referring to FIGS. 1 and 2, jacket 10 includes a shell 12 and a liner 14, which is preferably water resistant. Forming a torso portion of the jacket 10 are front and back shell panels 16 and 18 of the shell 12 and front and back liner panels 20 and 22 of the liner 14. Each of the panels 16, 18, 20, and 22 of the torso preferably includes a plurality of smaller panels selected for styling of the jacket 10 and to provide a desired shape. A closure, preferably a main zipper 24, is attached to the liner 14 and shell 12 and extends down the center of the front of the jacket 10 to separably join the front panels 16 and 20. At the bottom of the torso portion is bottom hem 26 that includes an elastic portion 28 to drawl the bottom hem 26 snugly around the wearer. When the main zipper 24 is closed, the shell 12 and the liner 14 are configured to encircle a wearer.

Jacket 10 has sleeves 30 which include sleeve portions 32 and 34 of the shell 12 and liner 14. Cuffs 36 attached to the ends of the sleeves are preferably adjustable in circumference to fit various wrist sizes. Thus, cuffs 36 preferably are elastic and have flaps 38 that snap to one of at least two locations in the cuff 36 to vary the size thereof.

The liner 14 and shell 12 are sewn together at edges 40 thereof. Sewn edges 40 are located where the sleeves 30 meet the cuffs 36, on each side of the main zipper 24, around the collar 41 of the jacket 10, and at the bottom hem 26. Between the sewn edges 40, the shell 12 and the liner 14 are substantially free from each other. The inside of the shell 12 and liner 14 thus define an inner space 42 therebetween.

Referring to FIGS. 1–4, on the inside of the shell 12, which faces the liner 14, and within the inner space 42, the shell includes reinforcing webs 44. The webs 44 are substantially triangularly shaped, preferably pie-slice shaped, with a convexly curved base and are sewn to the front shell panels 16 along the curved bases 46, with the bases 46 facing the main zipper 24. The webs 44 have web openings 48 about which are attached eyelets 50. The curved bases 46 are wider than the web openings 48. Shell openings 52 defined in the front shell panels 16 are also reinforced by eyelets 50 and are substantially aligned with the web openings 48.

On the outside of the shell 12, which faces away from the liner 14, straps 54 are sewn to the front shell panels 16, opposite the centers of the curved bases 46 of the webs 44. The straps 54 are attached to anchors, which are preferably chordlocks 56. Chordlocks 56 each include a housing 58 and a clamping portion 60, which together define a chordlock opening 62 and which are biased relative to each other towards a clamping position by spring 64, positioned therebetween. When tensioned away from the main zipper 24, the web opening 48, the shell opening 52, and the chordlock opening 62 are substantially aligned with each other.

The shell 12 additionally includes pockets 66 formed by pocket covers 68. The shell openings 52 are disposed within the pockets 66. Pocket zippers 70 of the shell 12 selectively open or close the pockets 66. A pocket flap 72 on the outside of the shell 72 covers each pocket zipper 70.

The jacket 10 also has a cinch 74, including an elastic band 76 and draw chords 78, which is also preferably elastic. The elastic band 76 is disposed in the inner space 42. The draw chords 78 are passed through eyelets 79 in the ends of the elastic band 76 and sewn back upon themselves. The draw chords 78 are received through the web opening 48, shell opening 52, and chordlock opening 62.

The elastic band 76 has a band height 80 perpendicular to the length of the band between the eyelets 79. The inner space 42 has a height 81, which is preferably at least three times as large as the band height 80. This retains maximum mobility when a wearer is practicing a sport such as golf.

Figure 3:
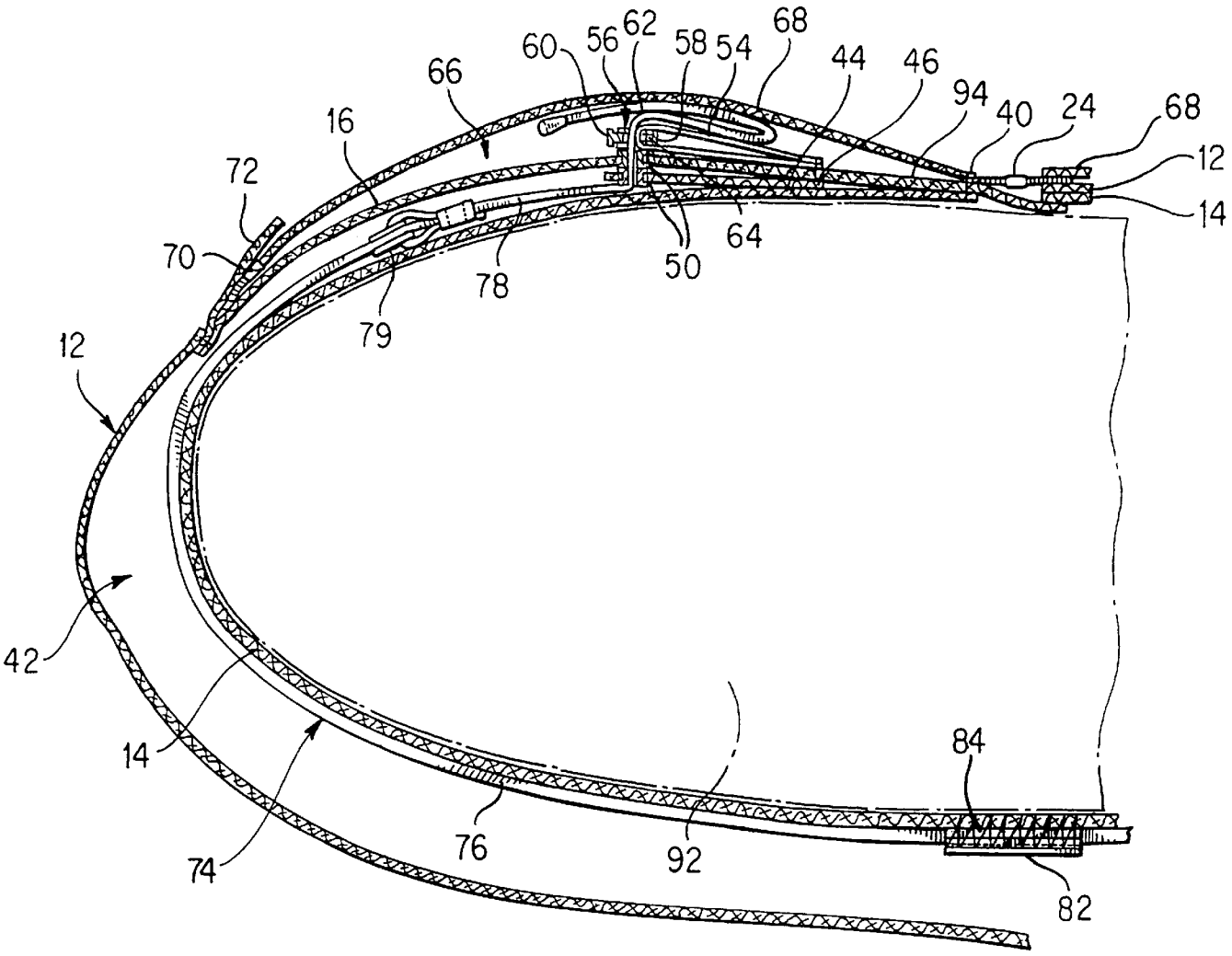
FIG. 3 is a cross-sectional top view of a portion of the jacket.
Figure 5:
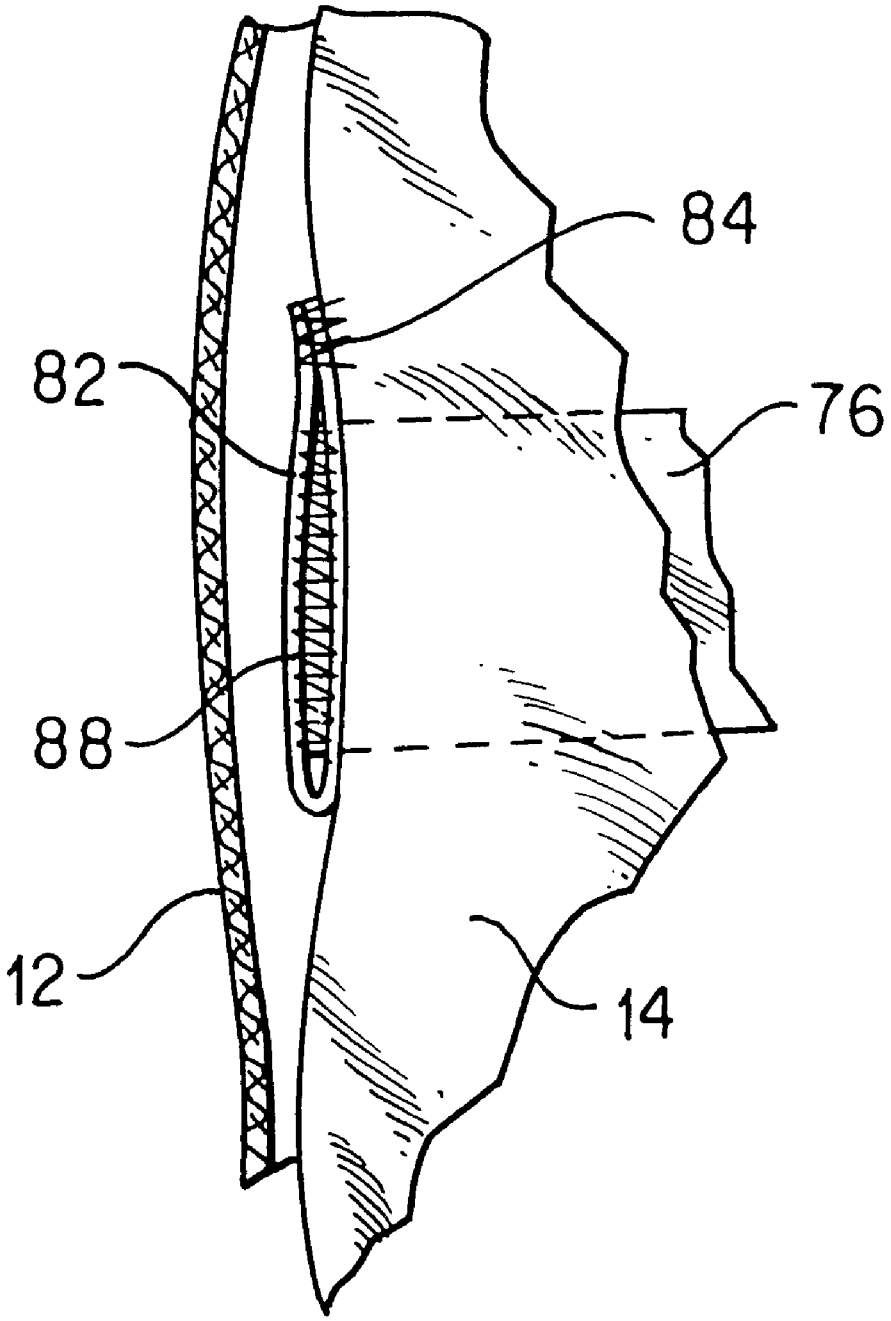
FIG. 5 is a cross-sectional side view of a portion of the back of the jacket.

As shown in FIGS. 2, 3, and 5, a loop 82 of fabric is sewn to the liner at stitching 84 located at the top of the loop 82. The elastic band 76 is received through the loop 82 and sewn thereto at stitching 88. The loop 82 fixes the elastic band 76 to the liner 14 to retain the cinch 74 around the abdomen portion of the jacket 10, preventing the cinch 74 from sliding vertically from its ideal position.

Figure 4:
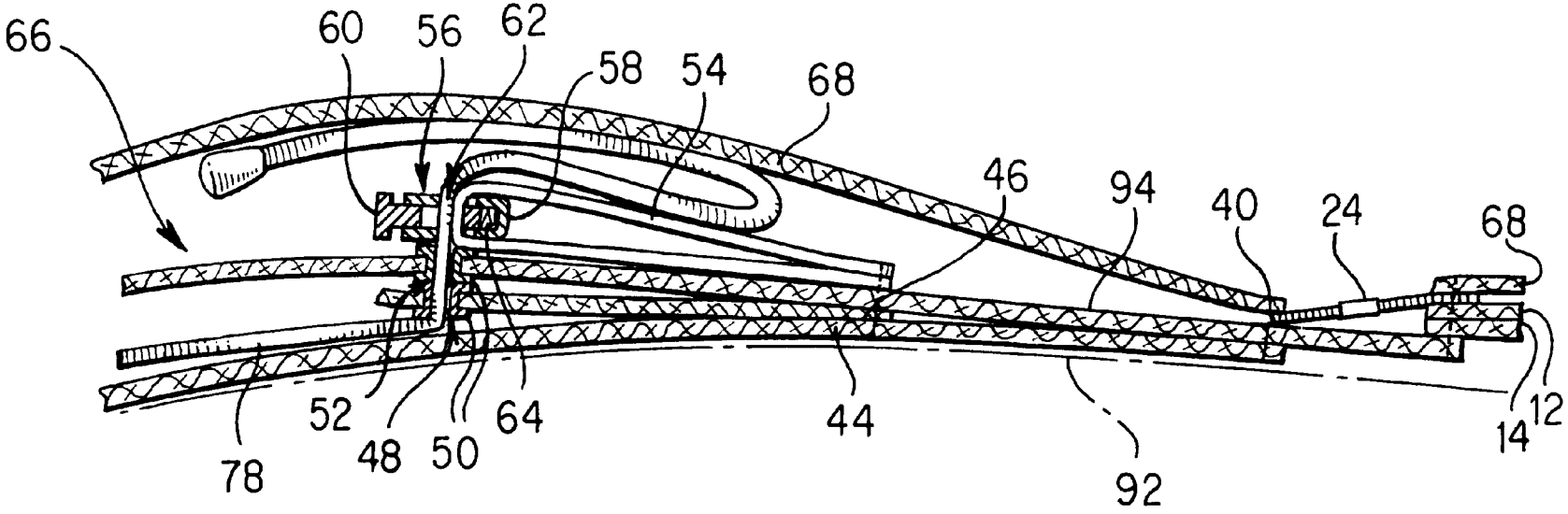
FIG. 4 is a blown up cross-sectional view of a portion of the front of the jacket.

FIGS. 3 and 4 show the one of the draw chords 78 anchored to the shell 12 by one of the chordlocks 56. The chordlock 56 is dimensioned larger than the shell opening 52 and is thus prevented from passing therethrough. The chordlock 56 is clamped to the drawchord 78 and the strap 54. The elastic band 76 is stretched by a distance from a naturally assumed length, and the drawchord 78 pulls the chordlock 56 against the shell opening 52. As the chordlock 56 is not receivable through the shell opening 52, the drawchord 78 is anchored to the shell 12 in a first position relative thereto. The area about the shell opening 52 thus forms an anchored portion of the jacket 10. The portion of the drawchord 78 on the outside of the shell 12 remains inside the pocket 66 and hidden from view. The drawchord 78 also pulls against the web 44, which reinforces the shell 12. A similar arrangement is present on the other side of the jacket 10.

A closed path extending around the abdomen portion of the jacket 10 and encircling the abdomen of the wearer 92 is defined by the cinch 74 and by a tensionable portion 94 of the shell 12, which is located at the front of the jacket 10 between the locations at which the drawchords 78 are anchored. The tensionable portion 94 preferably extends across more than a third of the front of the jacket 10. The closed path extends across the zipper 24. As the elastic band 76 and sections of the drawchords 78 are stretched, tension is produced along the closed path. As a result, the liner 14 and the tensionable front portion 94 of the shell 12 are drawn against the wearer 92. The wide base 46 of the web 44 effectively widens the closed path by spreading the tension produced by the stretched cinch 74 across a greater area of the front of the shell 12, widening the tensionable portion 94. Preferably, the base 46 of the web 44 is at least about three times wider than drawchord 78, the shell and web openings 48 and 52, or the eyelets 50.

As a result, fullness is removed from the front of the shell 12, which is pulled out of the way of the wearer's golf swing. The remainder of the shell 12 on the sides and back of the jacket 10 is free from the tension of the cinch 74 and thus remains full.

Figure 6:
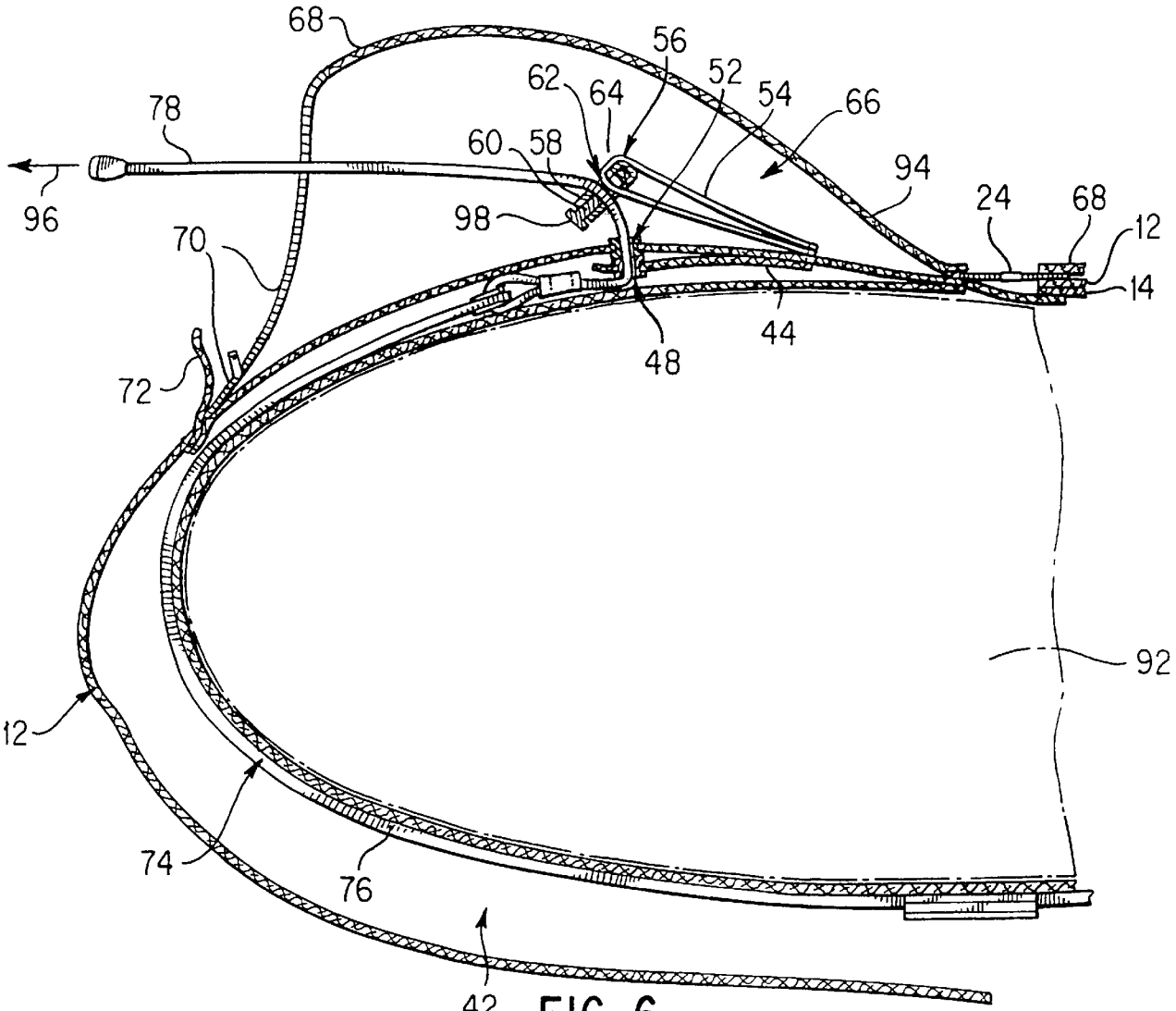
FIG. 6 is a cross-sectional top view of a portion of the jacket with an open pocket.

FIG. 6 illustrates how the cinch 74 is adjusted. The main zipper 24 is still closed and the jacket 10 is still being worn. The pocket zipper 70, however, is opened so that the drawchord 78 and the chordlock 56 are manipulable from the outside of the jacket 10. The drawchord 78 is pulled out from the pocket 66 as illustrated by arrow 96.

The strap 54 retains the chordlock 56 in the pocket 66 and relatively near the shell and web openings 52 and 48. The configuration of the clamping portion 60 and the stiffness of the spring 64 are such that the chordlock 56 resists displacement of the drawchord 78 therethrough resulting from the cinch 74 tension, but such that the drawchord 78 may be pulled further through the chordlock 56 when biased with a force greater than achievable by the cinch 74. Thus, by pulling the drawchord 78 out from the pocket, as shown, the elastic band 76 is further stretch. When the cinch 74 is being stretched as shown by pulling the drawchords 78, the chordlock 56 and the tensionable portion 94 of the shell 12, including the web 44, resist the pulling.

In FIG. 6, the chordlock 56 is shown stretched by a greater distance than it is in FIG. 3. When the drawchord 78 is released by the wearer, the chordlock 56 again clamps against the drawchord 78 and anchors the drawchord 78 to the shell 12 in a second position relative to thereto. With the drawchord 78 anchored in the second position, the cinch 74 pulled tighter about the abdomen of the wearer than when the drawchord 8 is in the first position relative to the shell 12.

To loosen the cinch 74, the wearer opens the pocket 66 and presses the top 98 of the chordlock clamping portion 60 into the housing 58, releasing the grip of the chordlock 56 on the drawchord 78 and allowing the elastic member 76 to contract, drawing the drawchord 78 back through the chordlock 56 to a looser position.

When the wearer unzips the main zipper 24 and removes the jacket 10, opening the previously closed path, the chordlocks 56 remain associated with the drawchord 78 and the shell 12 such that no adjustments need to be completed prior to reclosing the main zipper 24. In the preferred embodiment, the chordlocks 56 remain secured to the drawchord 78 so that the elastic band 76 is automatically stretched when the main zipper 24 is again closed about wearer.

Furthermore, any cinch 74 adjustments can be performed while the jacket 10 is being worn. Consequently, the wearer can feel changes is cinch 74 tension as they are made, and need not engage in a trial-and-error iterative approach that would be required if the jacket needed to be removed for adjustments. In addition, the cinch 74 tension is infinitely variable.

Figure 7:
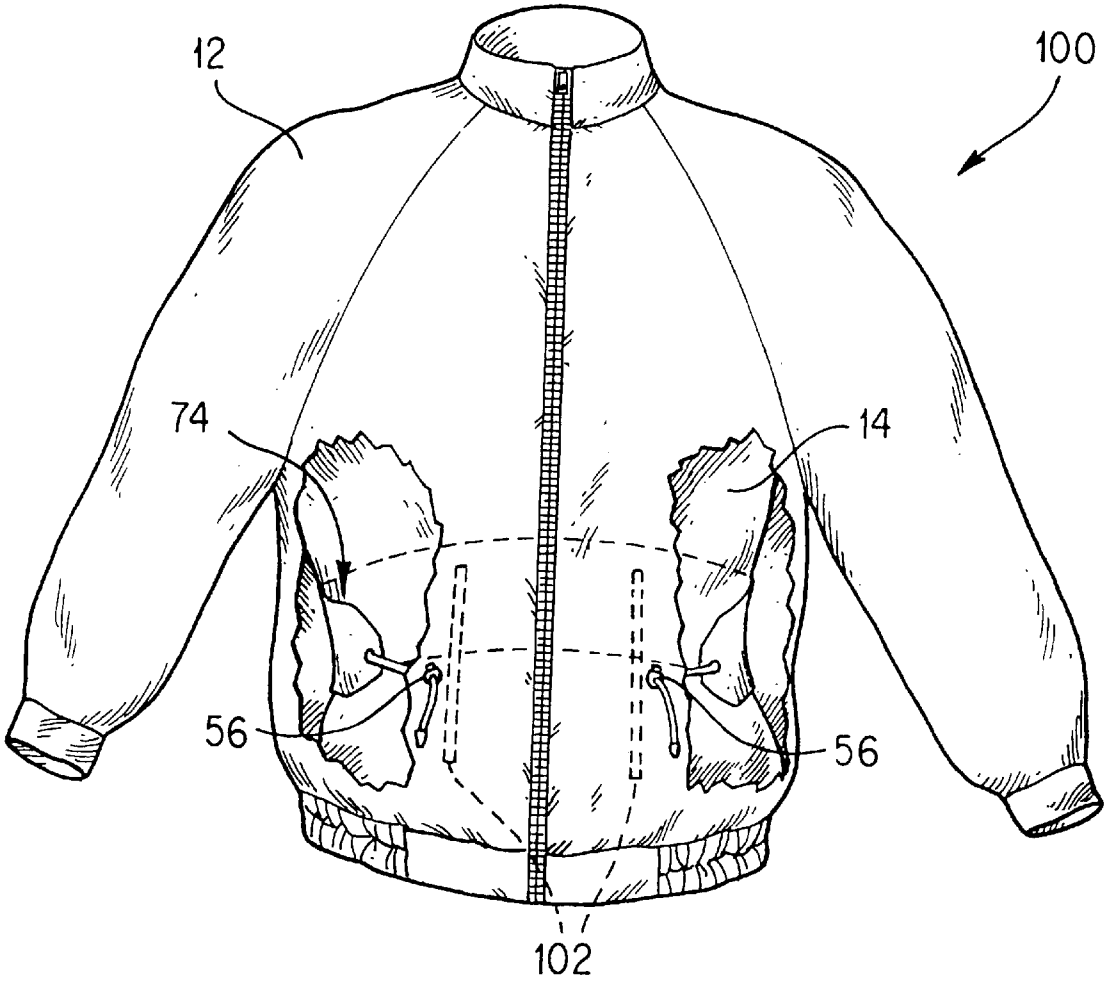
FIG. 7 is a cutaway front view of an alternative embodiment of a jacket constructed according to the invention.

Referring to the alternative embodiment of FIG. 7, jacket 100 includes resilient tension-spreading vertical bars 102 sewn to the inside of the shell 12 on each side of the main zipper 24. Thus, bars 102 are disposed in series with each other along the closed path. For clarity, the jacket pockets are not shown in FIG. 7. The bars 102 distribute the tensile force of the cinch 74 over a large tensionable portion 104 of the jacket 100 as the cinch 74 pulls the shell eyelets 50 away from each other.

Figure 8:
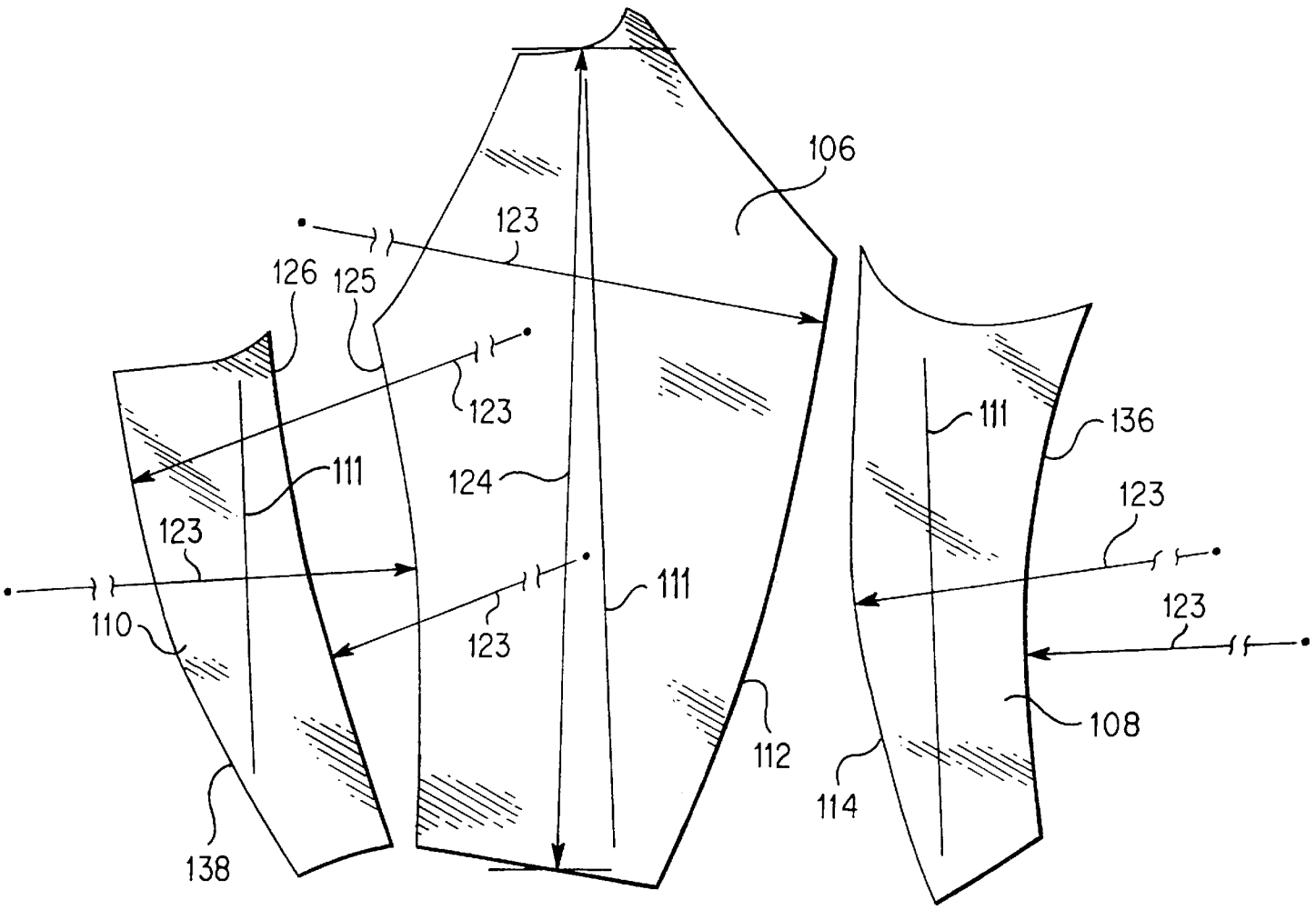
FIG. 8 is a view of the preferred panels of the jacket shell sleeves.

Referring to FIGS. 1, 2, and 8, each sleeve 30 of the preferred embodiment preferably includes three fabric panels that extend from sleeve shoulder, where they are attached to the torso portion of the jacket, to the cuff 36. These panels are top panel 106, rear panel 108, and forward panel 110. Lines 111 show the orientation of the fabric in each panel selected to minimize fabric usage when the panels are cut from a stock sheet, and also to provide the appropriate stretch qualities in each direction in the panels. The fabric in the forward panel 110, for example, has fibers oriented along line 111, diagonally to the length of the forward panel 110.

Back generally convex edges 112 and 114 of the top and rear panels 106 and 108 are attached to each other at a back seam 116, shown in FIG. 2. The back seam 116 runs along the back of the sleeve 30 from the back of the sleeve shoulder 118 to the back of the sleeve elbow 120 and to the back of the sleeve wrist 122, where the sleeve 30 attaches to the cuff 36.

Because the back seam 116 is disposed directly behind the elbow of the wearer, the shape of the back seam 116 directly affects the mobility of the wearer's arm within the sleeve 30. The edges 112 and 114 of the top and rear panels 106 and 108 have convex curvatures of radii 123 that decrease towards the elbow 120. The radii 123 preferably reach a maximum about half way between the elbow and the wrist 122, with the edges 112 and 114 curved along substantially their entire extend. Radii 123 of edges 112 and 114 preferably reach a minimum of less than about three times length 124 of the sleeve 30 from the top of the shoulder, where the sleeve 30 is sewn to the jacket collar 41, to the wrist. More preferably, the minimum radii 123 are less than about the length 124 of the sleeve 30. Back edge 114 has an average curvature that is preferably more curved than the average curvature of back edge 112.

This construction provides extra room behind the wearer's elbow to allow the elbow to bend without substantially pulling the cuff 36 away from the wearer's wrist. Additionally, the extra room provided at the back of the sleeve 30 by the back seam 116 permits the cuff 36 to stay positioned properly about the wearer's wrist during a golf upswing, when an arm of the wearer is extended across the wearer's chest.

Front generally concave edges 125 and 126 of the top and forward panels 106 and 110 are attached to each other at a front seam 128, shown in FIG. 1. The front seam 128 runs along the front of the sleeve 30 from the front of the sleeve shoulder 130 to the front of the sleeve elbow 132 and to the front of the sleeve wrist 134. Preferably, front edge 126 has a smaller average curvature than front edge 125. The two concave edges 125 and 126 of the top and forward panels 106 and 110 with radii 123 provide a natural bend in the sleeve 30 with the arms at rest position. Also, because this bend reduces the amount of fabric at the front of the elbow 132, bunching and excessive bagginess of the panels at this location is reduced.

A bottom concave edge 136 of the rear panel 108 is attached to a bottom convex edge 138 of the forward panel 110 at a bottom seam 140. The bottom edges 136 and 138 are curved with radii 123. The average curvature of concave bottom edge 136 is preferably greater than that of convex bottom edge 138, but the radius 123 of curvature of at the elbow of convex bottom edge 138 is smaller than the radius 123 at the elbow of concave edge 136. The bottom seam 140 runs along the bottom of the sleeve 30 from the bottom of the sleeve shoulder 142, or armpit, to the bottom of the sleeve elbow 144 and to the bottom of the sleeve wrist 146. Bottom seam 140 is preferably configured to permit the wearer's arms to extend above the head of the wearer while only minimally lifting the hem 26. The bottom seam 140 also helps control the taper of the sleeve 30 towards the wrist, which preferably allows the wearer's wrist to bend back, without the cuff 36 being pulled from its proper position. This taper can be controlled by the shape of the bottom edges 136 and 138 without compromising the shapes of portions of the sleeve at other seams.

The three sleeve seams not only allow the use of three different fabrics in the sleeves 30, they also produce complex curves in the sleeves 30, permitting effective control over the room provided within the sleeves 30 at any station along the length of the sleeves 30. The locations of the seams allow localized control over the shape of the sleeves 30. As explained above, the resulting sleeves 30 permit a full range of motion throughout a golf swing and allow this motion without substantial displacement of the cuffs 36.

To further increase the amount of room behind and below the wearer's elbow, the concave edges 136 and 125 of the top and rear panels 106 and 108 are more sharply curved than the convex edges 112 and 114 of these panels 106 and 108. On the other hand, to diminish the bagginess at the front of the sleeve, the concave edge 126 of the forward panel is less curved than the convex edge 138 thereof.

As a result of the preferred complex curves of the sleeves 30, the sleeve cannot be lied flat on a planar surface. When this is attempted, at least a fold results in the sleeves 30 near the cuffs 36.

As shown in FIG. 1, each sleeve 30 includes a small pleat 148 adjacent the cuff 36. The three seams described above that extend from shoulder to the wrist eliminate the need for substantial pleats. Pleat 148 is provided to produce an accelerated narrowing of the sleeve 30 at the wrist. At least a proximal portion 150 of the sleeve 30, however, which extends from the shoulder towards the wrist over ⅔ of the length 124 of the sleeve 30, is preferably substantially free of pleats.

One of ordinary skill in the art can envision numerous variations and modifications. For example, the cinch may be anchored to the shell by hook and loop fasteners permitting the cinch to be anchored at a plurality of locations on the shell. All of these modifications are contemplated by the true spirit and scope of the following claims.

What is claimed is:

1. A garment comprising:

(a) a liner;

(b) an outer shell having an outside facing away from the liner and an inside facing the liner to define an inner space therebetween, the shell including first and second anchored portions and defining an opening in the first anchored portion, the shell also including a tensionable portion disposed between the anchored portions, wherein the shell and liner are configured for encircling a body part; and (c) a cinch including an elastic band disposed in the inner space and attached to first and second ends which are anchorable to the first and second anchored portions, respectively, such that a closed path encircling the body part is defined through the cinch and the tensibnable portion, wherein the first end:

(i) extends through the opening, (ii) includes a manipulable portion disposed on the outside of the shell, and (iii) is anchorable to the first anchored portion such that the elastic band is selectively stretched by first and second distances when the garment is placed around the body part for variably tensioning the tensionable portion.

2. The garment of claim 1, wherein:

(a) wherein the shell and liner include an abdomen section configured for encircling a wearer's abdomen;

(b) the closed path extends around the abdomen section; and (c) the tensionable portion extends across a front part of abdomen section such that fullness is removable from the front part by the elastic band.

3. The jacket of claim 2, wherein:

(a) the shell and the liner are attached at top and bottom edges thereof; and (b) the inner space extends substantially between the edges.

4. A jacket having a torso section including an abdomen section, the jacket comprising:

(a) a liner;

(b) an outer shell having an outside facing away from the liner and an inside facing the liner to define an inner space therebetween extending through the torso section, the shell including first and second anchored portions in the abdomen section and defining a first opening in the first anchored portion, the shell also including a tensionable portion disposed between the anchored portions; and (c) a cinch including an elastic band disposed in the inner space and attached to first and second ends which are anchorable to the first and second anchored portions, respectively, such that a closed path around the abdomen section is defined through the cinch and tensionable portion, wherein the first end:

(i) extends through the first opening, (ii) includes a first manipulable portion disposed on the outside of the shell, and (iii) is anchorable to the first anchored portion such that the elastic band is selectively stretched by first and second distances when the jacket is worn for variably tensioning the tensionable portion.

5. The jacket of claim 4, wherein the tensionable portion is located at a front of the abdomen section.

6. The jacket of claim 4, wherein:

(a) the cinch includes an anchor securable to the first end and dimensioned larger than the first opening such that the anchor is prevented from passing through the first opening.

7. The jacket of claim 6, wherein:

(a) the shell includes a pooket on the outside thereof; and (b) the first opening is disposed inside the pocket such that the first end and the anchor are operable for releasably securing to each other from inside the pocket.

8. The jacket of claim 6, wherein:

(a) the anchor is attached to the shell to retain the anchor when the first end is pulled from outside the shell.

9. The jacket of claim 4, wherein:

(a) the elastic band has a band length between the ends and a band height perpendicular thereto; and (b) the inner space hats a space height parallel to the band height and at least three times as large as the band height.

10. The jacket of claim 4, further comprising:

(a) a closure attached to the liner and the shell in the tensionable portion, the closed path being defined when the closure is closed.

11. The jacket of claim 10, wherein:

(a) the cinch includes an anchor anchorable to the first end and the first anchored portion; and (b) the anchor is connected with the first end and the first anchored portion such that the anchor remains associated therewith when the closure is open for automatically stretching the elastic band around a wearer when the closure is closed.

12. The jacket of claim 4, wherein:

(a) the elastic band is fixed at a mid-section thereof to the liner.

13. The jacket of claim 4, further comprising:

(a) a reinforcing web attached to the inside of the shell and having a web opening that is substantially aligned with the first opening and that receives the first end for reinforcing the shell.

14. The jacket of claim 13, wherein:

(a) the reinforcing web has a base which is attached to the shell and which is wider than the first opening for spreading tension from the elastic band over the tensionable portion of the shell.

15. The jacket of claim 14, wherein:

(a) the reinforcing web comprises a substantially triangularly shaped web.

16. The jacket of claim 4, further comprising:

(a) a tension spreader attached to the tensionable portion of the shell across the closed path for spreading tension from the elastic band over the tensionable portion.

17. The jacket of claim 16, wherein:

(a) the tension spreader includes first and second resilient members attached to the tensionable portion of the shell in series along the closed path such that tension from the elastic band is spread over the tensionable portion.

18. The jacket of claim 4, wherein:

(a) the shell defines a second opening in the second anchored portion;

(b) the second end extends through the second opening and includes a second manipulable portion disposed on the outside of the shell for anchoring to second anchored portion for varying the first and second distances of elastic band stretch.

19. An garment having an upper body section, comprising:

(a) a torso portion; and (b) a sleeve having a shoulder, an elbow, and a wrist, which together comprise a plurality of panels including first and second panels that extend from the shoulder to the wrist and are attached to each other by a back seam, wherein:

(i) the shoulder is attached to the torso portion such that the back seam runs from a back of the shoulder to a back of the elbow to a back of the wrist, and (ii) the first and second panels have back edges joined at the back seam, each back edge having a convex curvature of radius a that decreases towards the elbow.

20. The garment of claim 19, wherein the minimum radius at the elbow is less than about three times a length of the sleeve from a top of the shoulder to a top of the wrist.

21. The garment of claim 19, wherein:

(a) two of the plurality of panels have concave front edges attached together at a front seam running from a front of the shoulder to a front of the elbow to a front of the wrist.

22. The garment of claim 21, wherein:

(a) the second panel has a concave bottom edge; and (b) the plurality of panels includes a third panel having a convex bottom edge attached to the bottom edge of the second panel at a bottom seam running from a bottom of the shoulder to a bottom of the elbow to a bottom of the wrist.

23. The garment of claim 22, wherein:

(a) at least a proximal portion of the sleeve extending from the shoulder towards the wrist over ⅔ of the length of the sleeve is substantially free of pleats.

24. The garment of claim 22, wherein:

(a) the convex edges of the panels have a radius of curvature that diminishes towards the elbow.

25. The garment of claim 24, wherein:

(a) the bottom edge of the third panel has an average curvature;

(b) the bottom edge of the second panel has an average curvature that is less the average curvature of the third panel; and (c) a minimum radius of curvature of the bottom edge of the third panel is less than a minimum radius of curvature of the bottom edge of the second panel.

26. The garment of claim 22, wherein:

(a) the edges of the panels have average curvatures, (i) the average curvatures of the concave edges of the first and second panels are more curved than the convex edges thereof, and (ii) the average curvature of the concave edge of the third panel is less curved than the convex edge thereof.

* * * * *

UNITED STATES PATENT AND TRADEMARK OFFICE
CERTIFICATE OF CORRECTION

PATENT NO. : 5,946,724

DATED : SEPTEMBER 7, 1999

INVENTOR(S) : Mark Edward Erickson

It is certified that error appears in the above-identified patent and that said Letters Patent is hereby corrected as shown below:

Col. 7 (claim 1), line 18, change "tensibnable" to --tensionable--.

Col. 8 (claim 9), line 18, change "hats" to --has--.

Col. 9 (claim 19), line 14, change "radius a" to --a radius--.

Signed and Sealed this

Twenty-ninth Day of February, 2000

*Attest:*

Q. TODD DICKINSON

*Attesting Officer*

*Commissioner of Patents and Trademarks*